United States Patent [19]

Lalonde

[11] 4,079,291

[45] Mar. 14, 1978

[54] ELECTRONIC LIGHTING DEVICE

[76] Inventor: François Lalonde, 6820 rue Chambord, Montreal, Quebec, Canada, H2G 3C3

[21] Appl. No.: 685,516

[22] Filed: May 12, 1976

[51] Int. Cl.[2] ..... H05B 7/18

[52] U.S. Cl. ..... 315/219; 315/206; 315/276; 315/283; 315/289; 361/262; 431/128

[58] Field of Search ..... 315/206, 208, 209 R, 315/219, 221, 283, 359, 276, 289; 431/128; 361/253, 262, 263

[56] References Cited

U.S. PATENT DOCUMENTS 3,174,535 3/1965 Weber ..... 315/209 R X

FOREIGN PATENT DOCUMENTS 1,332,123 10/1973 United Kingdom ..... 361/262

*Primary Examiner*—Eugene R. La Roche

[57] ABSTRACT

An electric arc lighting device for igniting inflammable products. The device comprises a direct current supply source and an oscillating unit constituted of a first inductance and an amplifying circuit connected in parallel with the supply source. The unit is adapted to generate an oscillation at a given frequency. A second inductance is connected in series with electrodes spaced one from another and between which the electric arc is produced at the given frequency and under a voltage induced in the second inductance by the first inductance, the first and second inductances being wounded around a same core.

6 Claims, 1 Drawing Figure

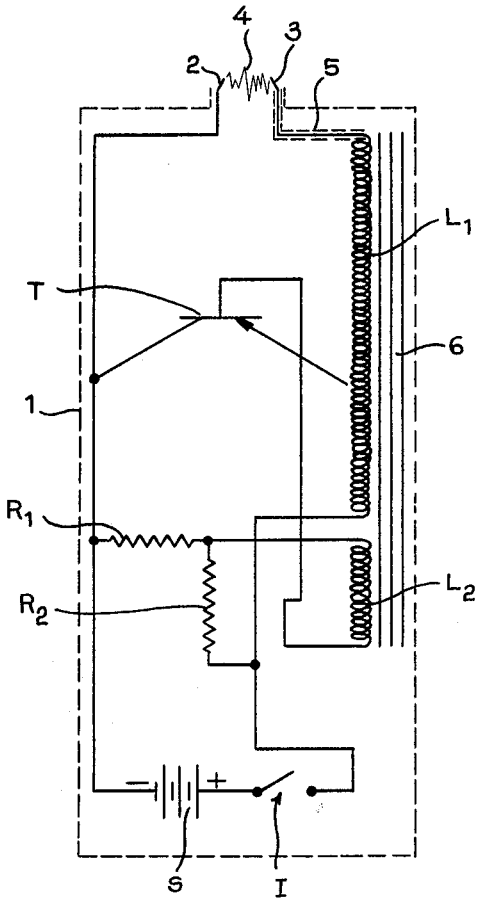
4
3
2
5
L1
T
6
1
R1
L2
R2
S
I

ELECTRONIC LIGHTING DEVICE

The present invention generally relates to devices for lighting combustible products or inflammable materials, and more particularly concerns a lighting device of a completely electronic operation and capable to ignite such products and materials when the latter are inserted between electrodes where an electric arc is formed.

Up till now, many attempts have been made to mingle and incorporate the modern electronic technology into lighting devices, in particular those of the pocket-size types, but such incorporation has been limited to substituting an electronic spark generating circuit for the conventional sparks generating flint to ignite the fuel ejected from the lighting device, the spark generating circuit having then a function identical to the conventional flints. Several electronic arrangements have been proposed in replacement of the lighter flint for producing the necessary sparks, and some are described, for example, in U.S. Pat. No. 3,311,789 to Remy, delivered on Mar. 28, 1967; in U.S. Pat. No. 3,372,306 to Kaozumi, delivered on Mar. 5, 1968; or in U.S. Pat. No. 3,779,692 delivered to Ballantyne on Dec. 18, 1973. Thus, there still subsists with the known lighting devices where the spark is produced by electronic means, the necessity of using not only fuel to achieve the lighting, but also it is necessary to accurately adjust the spark production time upon the time of ejection of the fuel used.

The device in accordance with the present invention overcomes the drawbacks inherent to the known lighting devices in promoting the lighting of inflammable products by means of an electric arc formed between two or more electrodes spaced from one another, the arc being entirely electronically controlled.

In accordance with the present invention, the lighting device comprises a direct current source feeding an oscillating unit constituted of an inductance and of an amplifying circuit connected across the source, that oscillating unit being adapted to generate an oscillation at a predetermined frequency. The electric arc is formed between electrodes which are connected in series with another inductance between the terminals of which a voltage is set, the value of that voltage being determined from that induced by the first-mentioned inductance. The two inductances are wounded around a same core so as to induce between the electrodes, a given voltage being at the frequency determined by the oscillating unit.

By way of example, the lighting device according to the present invention is of a particular interest when used as a compact pocket-size lighter or as a gas lighting means in kitchens or at camping sites, since even windy conditions do not substantially affect the operation of the present device.

A preferred embodiment of the present invention will be hereinafter described with reference to the accompanying drawing which illustrates an arrangement of the electronic components thereof.

Referring to the drawing, the arrangement shown therein may advantageously be used as a pocket or table lighter and wherein the electronic components are all integrated in a casing 1 having emerging electrodes 2 and 3. The electric arc 4 formed between the electrodes 2 and 3 serve to ignite by mere contact any combustible products. The electrode 2 is connected to the negative terminal of a direct current supply source S whereas the electrode 3 is connected in series with an inductance $L_1$ through a coaxial cable 5, that inductance $L_1$ supplying the high alternative voltage necessary to build up the electric arc 4. The other terminal of inductance $L_1$ is connected to the positive terminal of source S through the manual switch I.

The high AC voltage across the inductance $L_1$ is obtained from an oscillating unit constituted of an inductance $L_2$ mounted on a core 6 in ferrite, for example, and common to both inductances, and of an amplifying circuit to sustain the oscillation created in the inductance $L_2$. In the present embodiment, the amplifying circuit comprises a single transistor T.

As illustrated, the base of transistor T is linked to one of the terminals of the inductance $L_2$ wheresas its collector is connected to the other terminal of the latter inductance through a resistor $R_1$. That resistor $R_1$ forms part of a voltage divider made up of the resistors $R_1$ and $R_2$ to suitably bias the transistor. Moreover, the emitter of transistor T is so tapped on inductance coil $L_1$ to provide a bias for a proper operation of that transistor.

On the other hand, it is well known that the oscillation frequency is mainly determined by the value of the inductance $L_2$ and of the stray capacitance of the circuit as a whole, that stray capacitance being, in the illustrated arrangement, distributed and determined by the capacitance value of the core 6, the collector-base junction of the transistor T and by $L_2$. In the present embodiment, it therefore suffices to vary the number of turns of the inductance coil $L_2$ to obtain both the desired frequency and induced voltage for the electric arc 4. For instance, the present lighting device operates adequately when the oscillation frequency has a value ranging from about 1 Khertz to 5 Khertz and when the voltage across the terminals of the electrodes is approximately of 4 Kvolts. However, for sake of saving the current supplied by the source S a frequency of about 3.5 Khertz is desirable, the source of DC current being usually a rechargable battery of 3.6 volts and of the nickel-cadmium type. It is also to be noted that the oscillation frequency of the lighting device in accordance with the present invention may vary at use without hampering the proper operation of the lighting device.

Furthermore, the manual switch I is preferably inserted between the positive terminal of the source S and the lower terminal of the inductance $L_1$. Upon actuation of the switch I, the electric arc 4 is instantaneously formed across the electrodes 2 and 3.

A coupling capacitor (not shown) may be inserted between the emitter and the collector of transistor T.

It is understood that modifications may be brought to the general design and arrangement of the lighting device in accordance with the present invention without hampering the gist thereof. Thus, to the illustrated transistor T of the PNP type may be readily substituted a transistor of the NPN type without substantially modifying the operation of the present device, only the various biases having then to be changed.

I claim:

1. A lighting device for igniting inflammable products by means of an electric arc, comprising a manually operated switch; a low voltage direct current supply source in series with said switch; an oscillating unit mounted in parallel with said serially connected supply source and switch, and constituted of a first inductance and of a three-electrode semiconductive element so interconnected as to generate a continuous A.C. voltage of a frequency ranging from 1 Khertz to 5 Khertz; a second inductance wound around a core common with said first inductance and connected in series with electrodes spaced one from another and between which electrodes said electric arc is produced at said frequency and under a predetermined voltage induced in said second inductance by said first inductance, thereby creating a continuous electric arc between said electrodes when said manually operated switch is tripped and igniting said products when in contact with said electric arc.

2. A lighting device in accordance with claim 1, characterized in that said three-electrode element comprises a transistor, the terminals of said first inductance being connected respectively to the base and to the collector of said transistor whereas the emitter thereof is connected to said second inductance.

3. A lighting device in accordance with claim 1, characterized in that a voltage divider is connected across the terminals of said supply source, said divider being constituted of two serially connected resistive elements the junction point of which is connected to one of the terminals of said first inductance.

4. A lighting device in accordance with claim 1, characterized in that said second inductance is connected to one of said electrodes through a coaxial cable.

5. A lighting device in accordance with claim 1, characterized in that the continuous A.C. voltage frequency is approximately 3.5 Khertz and in that said predetermined voltage across the electrodes is of about 4 Kvolts.

6. A lighting device for igniting inflammable products by means of an electric arc, comprising a manually operated switch; a low voltage direct current supply source in series with said switch; electrodes spaced from one another and between which said electric arc is formed; a transistor; a first inductance mounted in series with said electrodes, said first inductance and electrodes being connected in parallel with said serially connected D.C. supply source and switch; a second inductance wound around a core common with said first inductance and having one terminal connected to the base of said transistor and the other terminal connected to the collector thereof through a resistive voltage divider mounted across said serially connected D.C. supply source and switch, the emitter of said transistor being tapped on said first inductance; said transistor and said second inductance forming an oscillating circuit having a frequency ranging from 1 khertz to 5 Khertz to sustain a voltage drop of about 4 Kvolts of said electric arc formed between said electrodes, whereby said inflammable products are ignited by mere contact with said thus formed electric arc upon tripping said switch.

* * * * *